US007451725B2

(12) United States Patent
Garrabrant et al.

(10) Patent No.: US 7,451,725 B2
(45) Date of Patent: Nov. 18, 2008

(54) WATER HEATER COMBUSTION CHAMBER SENSING SYSTEM

(75) Inventors: Michael A. Garrabrant, Unicoi, TN (US); Eric Arnold, Jonesborough, TN (US); Jeff L. Lyons, Gray, TN (US)

(73) Assignee: American Water Heater Company, Johnson City, TN (US)

( * ) Notice: Subject to any disclaimer, the term of this patent is extended or adjusted under 35 U.S.C. 154(b) by 203 days.

(21) Appl. No.: 11/316,296

(22) Filed: Dec. 22, 2005

(65) Prior Publication Data

US 2007/0144453 A1 Jun. 28, 2007

(51) Int. Cl.
*F24H 9/20* (2006.01)

(52) U.S. Cl. ..... 122/14.21

(58) Field of Classification Search ..... 122/14.1, 122/14.21, 14.2, 14.31
See application file for complete search history.

(56) References Cited

U.S. PATENT DOCUMENTS 6,053,130 A * 4/2000 Shellenberger ..... 122/14.21
6,293,230 B1 9/2001 Valcic et al.
6,715,415 B2 * 4/2004 Yamasaki et al. ..... 101/123
6,893,253 B2 * 5/2005 Stretch et al. ..... 431/77
6,957,628 B2 * 10/2005 Stretch et al. ..... 122/14.2
6,964,248 B2 * 11/2005 Stretch et al. ..... 122/14.2
7,290,502 B2 * 11/2007 Kidd et al. ..... 122/14.2

FOREIGN PATENT DOCUMENTS

JP 09114317 5/1997

* cited by examiner

*Primary Examiner*—Gregory A Wilson
(74) *Attorney, Agent, or Firm*—DLA Piper LLP (US)

(57) ABSTRACT

A combustion chamber is disposed below the water container of a water heater and formed at least partially by a shell. A burner disposed within the combustion chamber and a fuel supply line is connected to the burner. A valve associated with the fuel supply line. A combustion chamber sensor is disposed within the combustion chamber and adapted to sense a rise in temperature indicative of an abnormality in the combustion chamber. A circuit connected to the sensor and the valve such that the circuit triggers the valve to shut off fuel to the burner in response to a sensed temperature by the sensor.

16 Claims, 8 Drawing Sheets

WATER HEATER COMBUSTION CHAMBER SENSING SYSTEM

TECHANICAL FIELD

This disclosure relates to fuel-fired water heaters.

BACKGROUND

A commonly used gas-fired water heater is the storage type, generally comprising an assembly of a water tank, a main gas burner to provide heat to the tank, a standing pilot burner to initiate the main burner on demand, an air inlet adjacent the burner near the base of the jacket, an exhaust flue and a jacket to cover these components. Another type of gas-fired water heater is the instantaneous type which has a water flow path through a heat exchanger heated, again, by a main burner initiated from a pilot burner flame. For convenience, the following description is in terms of storage type water heaters. However, the invention is not limited to this type.

A particular difficulty with many locations for water heaters is that they are also used for storage of other equipment such as lawn mowers, trimmers, snow blowers and the like. It is common for such machinery to be refueled in such locations.

There have been a number of reported instances of spilled gasoline and associated fumes being accidentally ignited. There are many available ignition sources, such as refrigerators, running engines, electric motors, electric light switches and the like. However, gas water heaters have sometimes been suspected because they often have a continuously burning pilot flame and combustion air inlets disposed at or near floor level, where spillage may occur.

To contain ignitions that may occur due to the accidental spillage of fuel near a gas fired water heater, many manufacturers have incorporated flame traps into the design of their water heater. An example of such a design is disclosed in U.S. Pat. No. 6,293,230 to Valcic et al. The flame traps used in such designs comprise ports sized and shaped to cause air and extraneous fumes to pass through the ports at a velocity higher than the flame velocity of the extraneous fumes, thereby confining ignition and combustion of the extraneous fume species within the combustion chamber.

One potential problem associated with the ports of the flame arresters is that the ports may become clogged with lint, dust, oil or any other element that may become disposed in or around the ports. When the ports become clogged, there is a potential for the combustion of the burner to burn inefficiently and produce increased levels of CO.

One general consequence to both the emission of CO and the ignition of vapors is that the temperature in the combustion chamber rises above a normal operating level. It would be beneficial to provide a water heater with an improved system for detecting a rise in temperature in the combustion chamber and cut the fuel to the burner, thereby terminating combustion in the combustion chamber.

SUMMARY

We provide fuel-fired water heaters and devices for sensing combustion chambers of fuel-fired water heaters.

One aspect relates to a water heater having a water container; a combustion chamber disposed below the water container and formed at least partially by a shell having an interior surface; a burner disposed within the combustion chamber; a fuel supply line connected to the burner; a valve associated with the fuel supply line; a movable combustion chamber sensor disposed interiorly of the shell proximate to the interior surface of the shell, and adapted to sense a rise in temperature indicative of an abnormality in the combustion chamber; and a switch associated with the sensor and operatively associated with the valve such that the switch triggers the valve to shut off fuel to the burner in response to a sensed temperature by the sensor.

Another aspect relates to a combustion chamber temperature sensing system including a casing having a sensing extension, and a barrel portion; a sensor disposed within the barrel portion and adapted to operate from a concave to convex position upon reaching a predetermined temperature; a switch including a member having a fixed first end portion connected to a first terminal and a movable second end portion biased against a second terminal; and a shaft portion is disposed between the sensor and the member and adapted to move the second end portion away from the second terminal when the sensor shifts from a concave to a convex position.

A further aspect includes a water heater including a water container; a combustion chamber disposed below the water container and formed at least partially by a shell having an interior surface; a burner disposed within the combustion chamber; a fuel supply line connected to the burner; a valve associated with the fuel supply line; a movable combustion chamber sensor disposed interiorly of the shell proximate to the interior surface, and adapted to sense a rise in temperature indicative of a selected amount of carbon monoxide present in the combustion chamber; and a switch associated with the sensor and operatively associated with the valve such that the switch triggers the valve to shut off fuel to the burner in response to a sensed temperature by the sensor.

BRIEF DESCRIPTION OF THE DRAWINGS

For the purpose of illustration, there is shown in the drawings a form which is presently preferred; it being understood, that this disclosure is not limited to the precise arrangements and instrumentalities shown.

DETAILED DESCRIPTION

Figure 1:
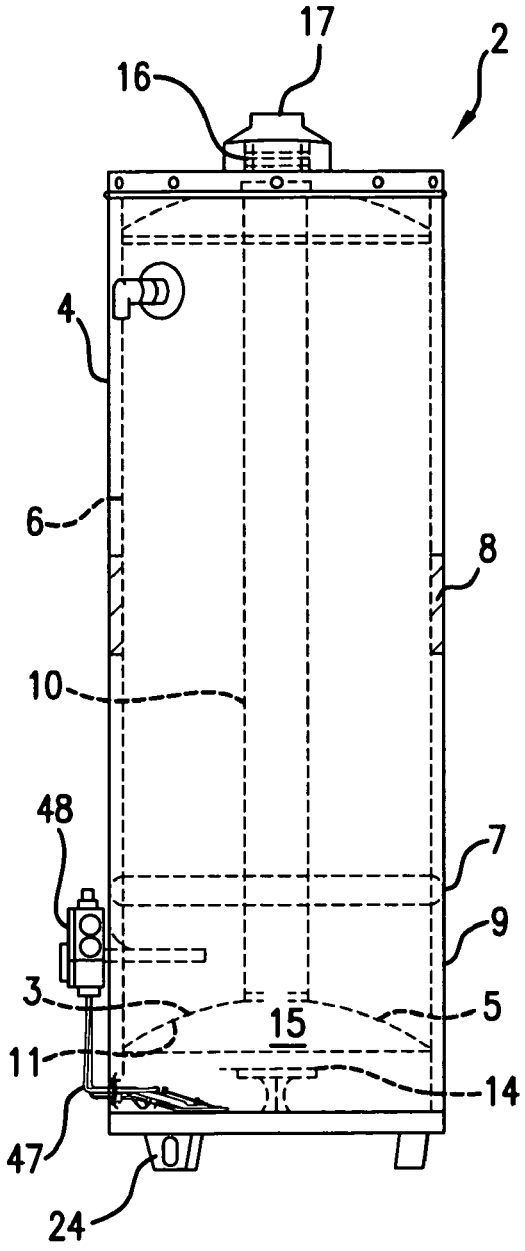
FIG. 1 is a side elevational view, taken partly in section, of a gas water heater.

It will be appreciated that the following description is intended to refer to specific aspects of the disclosure selected for illustration in the drawings and is not intended to define or limit the disclosure, other than in the appended claims.

Figure 2:
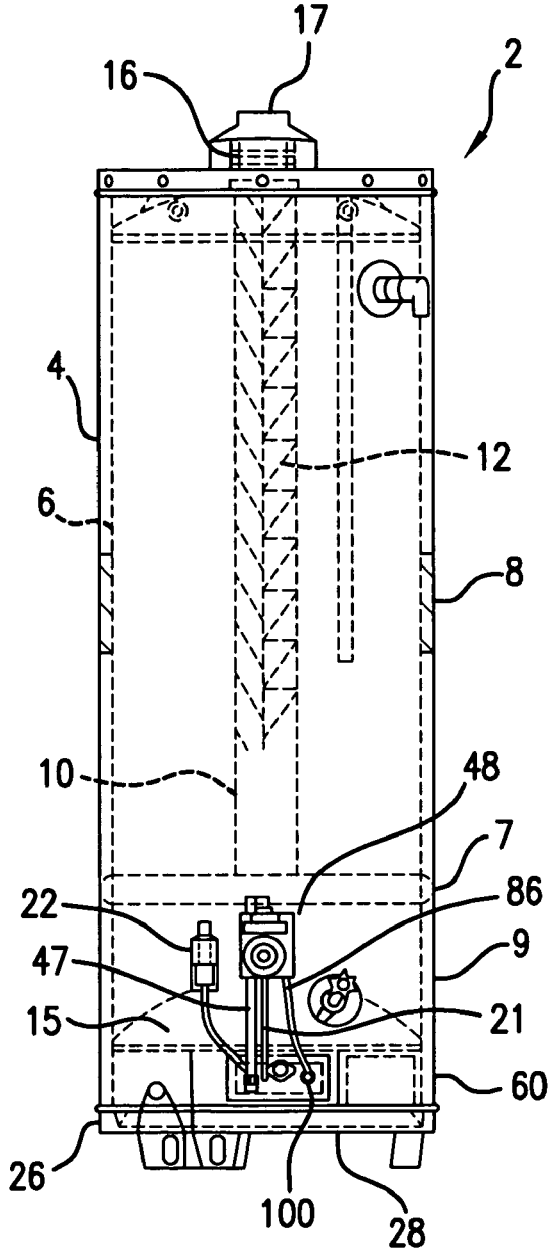
FIG. 2 is a front elevational view, taken partly in section, of the gas water heater shown in FIG. 1.

Turning now to the drawings in general and FIGS. 1 and 2 in particular, the number "2" designates a storage type gas water heater 2. The water heater 2 includes a jacket 4 which surrounds a water tank 6, and a main burner 14 in a combustion chamber 15. Passing through the center of the tank 6 is a flue 10, which incorporates a series of baffles 12 to better transfer heat generated by the main burner 14. The water tank 6 is preferably capable of holding heated water at a pressure at or exceeding that of any water main that may feed the water heater 2. The water tank 6 is preferably insulated by foam insulation 8. Alternative insulation may include fiberglass or other types of fibrous insulation, as is known to those skilled in the art. Preferably, fiberglass insulation 9 surrounds combustion chamber 15 and the lowermost portion of water tank 6. It is possible that heat resistant foam insulation can be used if desired. A foam dam 7 separates the foam insulation 8 and the fiberglass insulation 9.

Located underneath the water tank 6 is the main burner 14 which uses natural gas or other gases such as LPG, for example. Other suitable fuels may be substituted, as is known to those skilled in the art. The main burner 14 combusts a gas and air mixture and the hot products of combustion resulting rise up through flue 10, possibly with heated air. Preferably, the water tank 6 is lined with a glass coating for corrosion resistance. The bottom portion 5 of the water tank 6 is preferably coated on both its interior facing surface 3 and exterior facing surface 11. The thickness of the coating of exterior facing surface 11 is preferably about half of the thickness of the coating on the interior facing surface 3. Also, the lower portion of flue 10 is preferably coated on both of its opposing surfaces. The surface exposed to the flue gases preferably has a thickness about half the thickness of the surface exposed to water in water tank 6. The glass coating helps to prevent scaling of the flue and water tank surfaces.

Referring now to FIGS. 1-5, the combustion chamber 15 also contains a pilot burner 49 connected to a gas control valve 48 by a pilot fuel supply line 47. A sheath 52, preferably made of copper, containing wires (not shown) from a flame detecting thermocouple 51 to ensure that, in the absence of a flame at the pilot burner 49, the gas control valve 48 shuts off the gas supply. The thermocouple 51 may be selected from those known in the art. Robertshaw Model No. TS 750U is one preferred thermocouple. The gas control valve 48 supplies fuel to the burner 14 by way of a fuel supply line 21.

FIGS. 1-5 show the fuel supply line 21 and pilot fuel supply line 47 extending outwardly from a plate 25. The plate 25 is removably sealable to a skirt 60 that forms the side wall of the combustion chamber 15. The plate 25 is held into position by a pair of screws 62 or by any other suitable means. The pilot fuel supply line 47 and fuel supply line 21 preferably pass through plate 25 in a substantially fixed and sealed condition. The sheath 52 also extends through the plate 25 in a substantially fixed and sealed condition as does an igniter line 64. The igniter line 64 connects on one end to an igniter button 22 and on a second end to a piezo igniter 66 (see FIGS. 3 and 5). The igniter button 22 can be obtained from Channel Products, for example, however those skilled in the art will recognize that many variations of the igniter button 22 may be used. Each of the pilot fuel supply line 47, the fuel supply line 21 and the sheath 52 are removably connectable to the gas control valve 48 by compression nuts 68, 70 and 72, respectively. Each of the compression nuts 68, 70 and 72 are threaded and threadingly engage the control valve 48.

Referring now to FIGS. 1-5, the products of combustion pass upwards and out the top of the jacket 4 via a flue outlet 16 after heat has been transferred from the products of combustion to water contained in the water tank 6. The flue outlet 16 discharges conventionally into a draft diverter 17 which in turn connects to an exhaust duct leading outdoors, as is well known to those skilled in the art.

The water heater 2 is preferably mounted on legs 24. The water heater has a bottom pan 26, which is raised off of the floor by the legs 24. The bottom pan 26 preferably has one or more apertures 28 or some other means (not shown) for receiving combustion air, and allowing the combustion air to pass therethrough.

The gas control valve 48 is preferably electronically operated, as is well known to those skilled in the art. Preferably, when power is supplied to the gas control valve 48, the valve 48 is operable to the open position. Preferably, the valve 48 controls the flow of gas through both the fuel supply line 21 and pilot fuel supply line 47. Preferably, the valve 48 is connected to a fuel source (not shown) by an external fuel supply line (not shown) as is well known in the art. Power may be provided in mill-volts, generated by a thermocouple. However, those skilled in the art will recognize that the power may come from any suitable source. The power may be measured in milli-volts up to 240 Volts AC.

Preferably, the valve 48 is adapted to close when a source of power to the valve 48 is terminated. Closure of the valve 48 occurs in a manner that is well known. By way of example only, the valve 48 may be biased in the closed position by a spring and opened by an electronic actuator. When power to the electronic actuator is terminated, the spring may force the valve 48 to the closed position.

Figure 3:
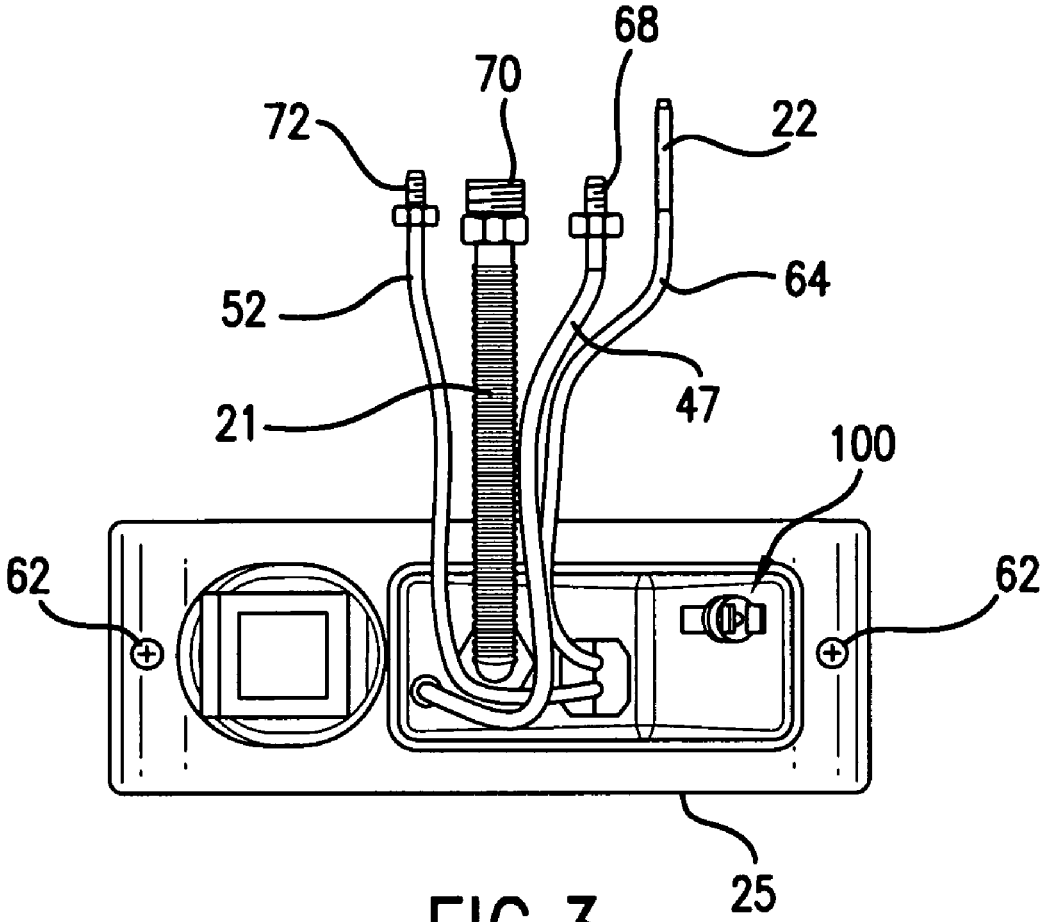
FIG. 3 is a front elevational view of selected parts of the lower portion of the gas water heater shown in FIG. 2.
Figure 5:
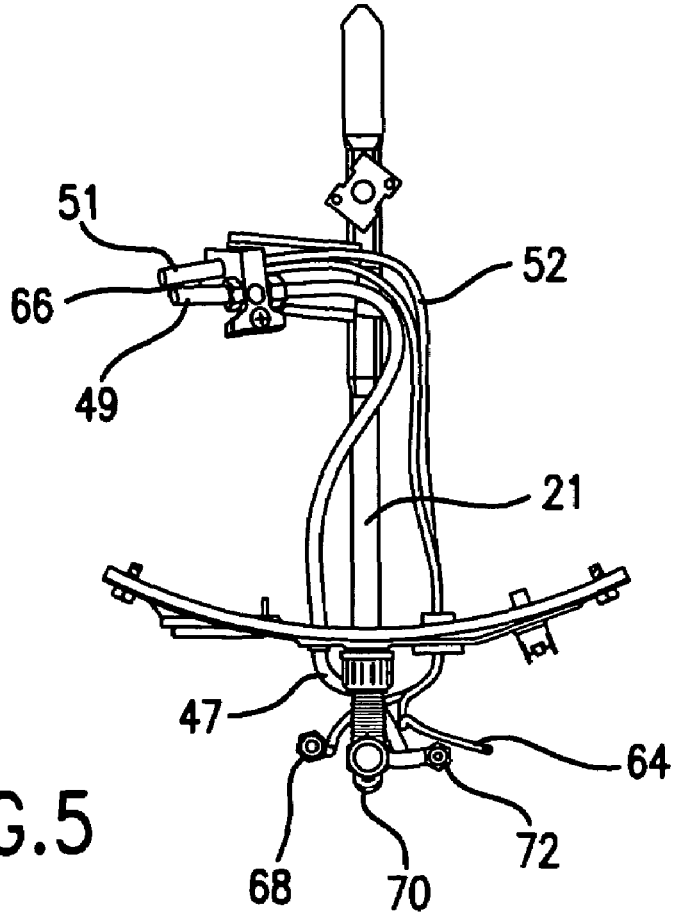
FIG. 5 is a top plan view of the assembly shown in FIG. 4.
Figure 6:
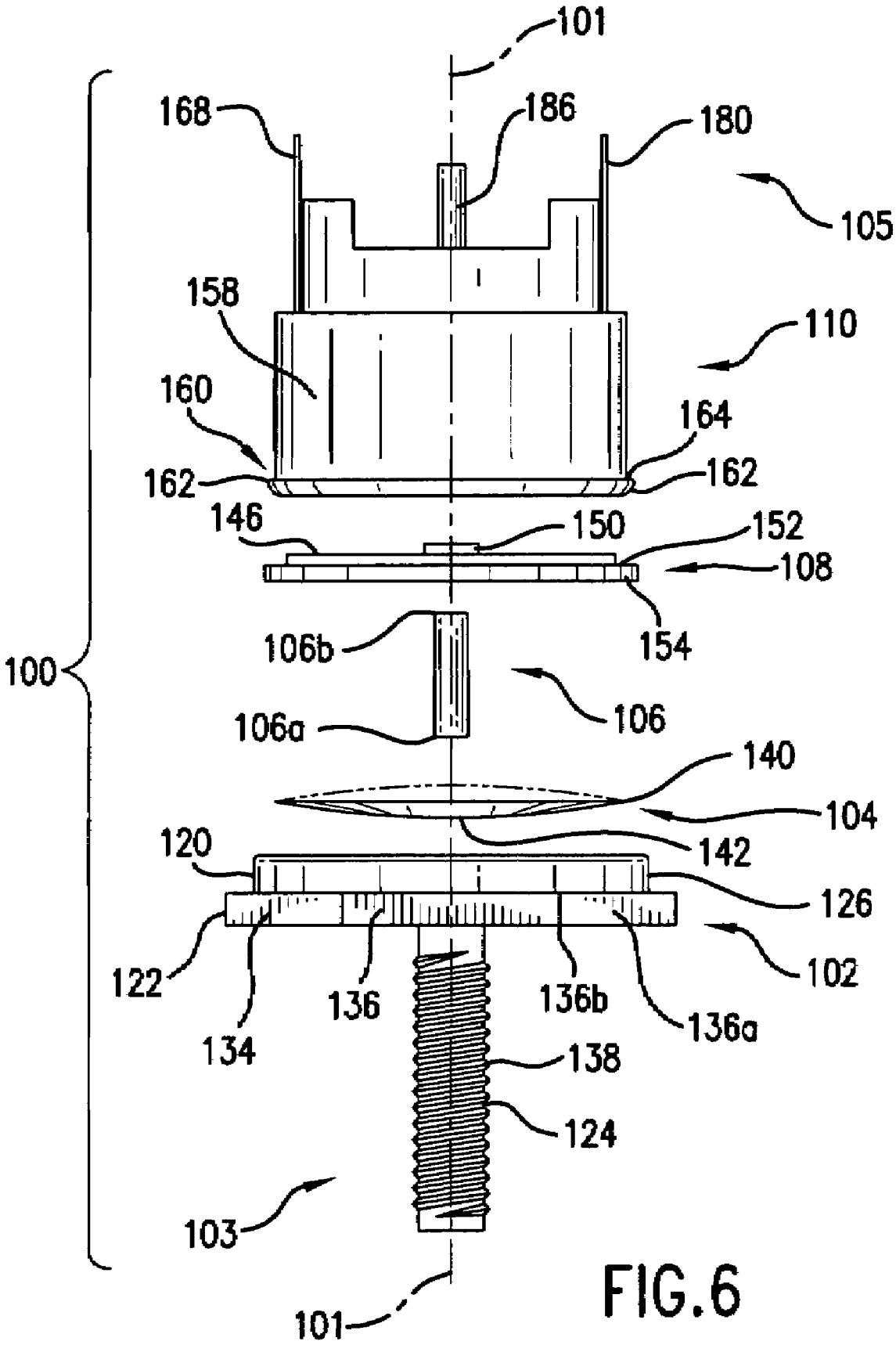
FIG. 6 is an exploded side elevational view of a sensing system.
Figure 7:
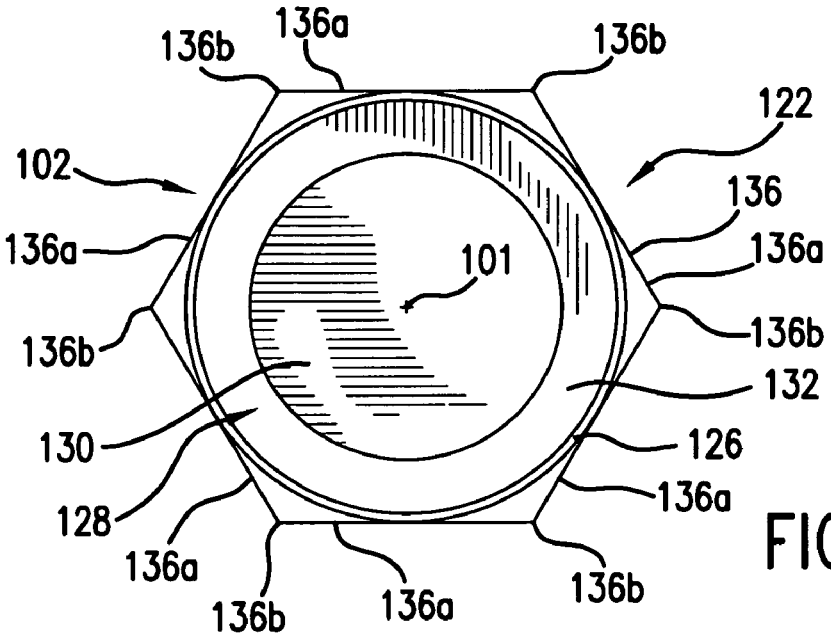
FIG. 7 is a top plan view of a casing portion shown in FIG. 6.
Figure 8:
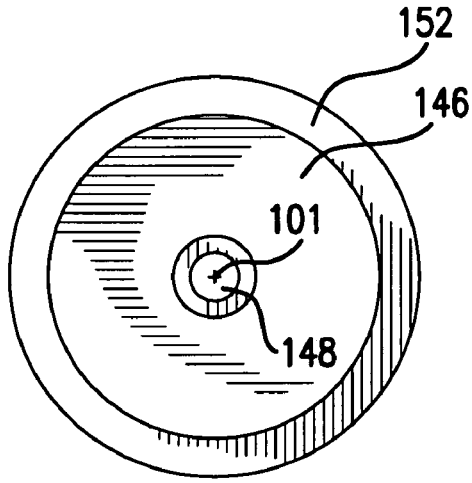
FIG. 8 is a top plan view of a spacer shown in FIG. 6.
Figure 9:
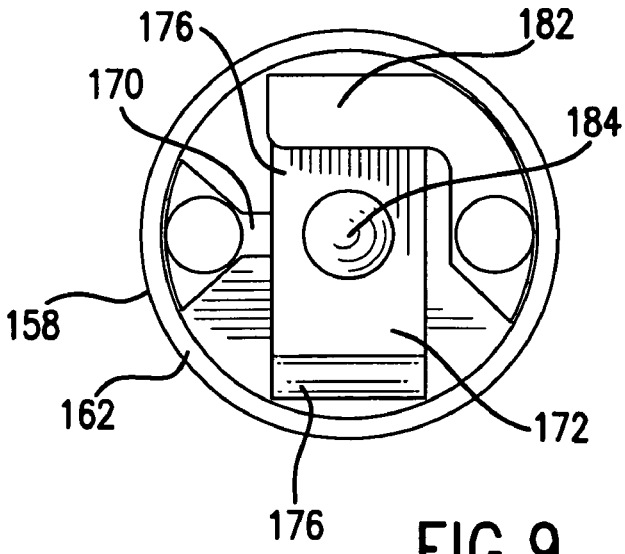
FIG. 9 is a bottom plan view of a circuit portion shown in FIG. 6.

Referring now to FIGS. 2, 3 and 5, a combustion chamber sensing system 100 is shown. The combustion chamber sensing system 100 is shown as being disposed on the plate 25, although it need not be. For example, it may be disposed on skirt 60 if desired. Preferably, the sensing system 100 may be electronically connected to the valve 48 by a wire 86. For purposes of describing the sensing system 100, the terms proximal and distal, respectively, refer to the directions closer to and away from the burner 14 disposed within the combustion chamber 15.

Referring now to FIGS. 6 to 12, the system 100 preferably comprises a sensor casing 102, a sensor 104, a shaft 106, a spacer 108, and a switch portion 110. The system further comprises a proximal end portion 103, a distal end portion 105 and a longitudinal axis 101 extending therethrough from the proximal end portion 103 to the distal end portion 105.

Preferably, the sensor 104 is disposed within the casing 102. The spacer 108 is disposed distally of the sensor 104, and the shaft 106 is inserted through a central passageway 148 in the central passageway 148 in the spacer 108. The switch portion 110 is disposed distally to the spacer 108, on an opposite side of the spacer 108 from the casing 102. When the sensing system 100 is disposed through the plate 25, the casing 102 is the part of the sensing system that is disposed closest to the burner 14. Correspondingly, the switch portion 110 is the part of the sensing system 100 that is disposed furthest away from the burner 14. While the sensing system 100 having a casing 102, sensor 104, and switch portion 110 is described herein, those skilled in the art will recognize that a variety of other specific structures may be utilized.

The casing 102, moving from a distal to proximal portion thereof, preferably comprises a barrel portion 120, a flange portion 122 and a sensing extension portion 124. The sensing extension 124 extends proximally from the flange portion 122 in a direction away from the barrel portion 120. Preferably, the barrel portion 120, is generally cylindrical and hollow. The barrel portion 120 comprises a generally circumferential exterior wall 126 that defines an interior cavity 128. A proximal end of the interior cavity 128 is further defined by an internal wall 130. The internal wall 130 is generally perpendicular to the longitudinal axis 101. A circumferential ridge 132 is disposed within the interior cavity 128. The circumferential ridge 132 extends substantially circumferentially around the outer edge of the internal wall 130, along the inner surface of the exterior wall 126. Preferably, a distal casing lip 166 extends distally and towards the longitudinal axis 101 from the exterior wall 126. While a circumferential barrel portion 120 is disclosed here, those skilled in the art will recognize that the barrel portion 120 may be any suitable shape.

The flange portion 122 is preferably disposed proximally of the barrel portion 120. Preferably, the flange portion 122 has a proximal flange wall 134 located on a proximal surface thereof and generally perpendicular to the longitudinal axis 101. Preferably, an exterior surface 136 of the flange portion 122 is generally hexagonal. The exterior surface 136 is made up of a plurality of exterior flat portions 136*a* and exterior corners 136*b*. The corners 136*b* of the hexagonal exterior surface 136 extend generally farther from the longitudinal axis 101 than the circumferential exterior wall 126 of the barrel portion 120. While a hexagonal shaped flange portion 122 is shown here, those skilled in the art will recognize that the flange portion 122 may have many different shapes.

Preferably, the sensing extension portion 124 extends proximally from the proximal flange wall 134 along the longitudinal axis 101. The sensing extension portion 124 comprises a generally elongated post. Preferably, an exterior surface 138 of the sensing extension portion 124 is threaded, although those skilled in the art will recognize that the exterior surface 138 may be smooth or have some other suitable texture without departing from the scope of the invention. One advantage of the threaded exterior surface 138 is that other articles may be connected to the sensing extension 124 with relative ease. Once installed in the water heater 2, the sensing extension is preferably the closest part of the sensing system 100 to the burner 14.

The sensor 104 is disposed within the interior cavity 128 and completely inwardly of skirt 60. The sensor 104 is a generally circular disc. The sensor 104 is preferably a bimetallic snap disc, which is well known in the art. The sensor 104 comprises an outer circumferential portion 140 and a central portion 142. The sensor 104 is generally biased in a concave position when viewed from the distal direction and convex when viewed from the proximal direction. For purposes of this disclosure, the concave position shall be interchangeably used with the unsnapped position.

Preferably, when the sensor 104 is inserted into the interior cavity 128, the outer circumferential portion 140 engages the circumferential ridge 132. The circumferential ridge 132 is raised enough from the internal wall 130 that when the outer circumferential portion 140 engages the circumferential ridge 132, the central portion 142 does not contact the internal wall 130. The sensor 104, while generally biased in a concave position, preferably operates to a convex position upon reaching a predetermined temperature.

The spacer 108 is generally circular, disc shaped, has a central passageway 148 and adapted to partially fit within the internal cavity 128 of the casing portion 102. Preferably, the spacer 108 is disposed generally perpendicular to the longitudinal axis 101. The spacer 108 comprises a proximal spacer surface 144 and a distal spacer surface 146. The spacer 108 comprises a central spacer passageway 148 adapted to allow the shaft 106 to pass therethrough along the longitudinal axis 101. A distal lip 150 extends distally from the distal spacer surface 146 and away from the skirt 60 toward the jacket 4. Preferably, the distal lip 150 extends circumferentially around the central spacer passageway 148. A circumferential reveal 152 is disposed around the outer edge of the distal spacer surface 146. A proximal lip 154 extends proximally from the proximal spacer surface 144. Preferably, the proximal lip 154 is disposed circumferentially around the outer edge of the proximal surface 144. When the sensing system 100 is assembled, the proximal lip 154 engages the circumferential ridge 132 of the casing portion 102. A proximal ridge 156 is disposed around an inner edge 155 of the proximal lip 154 and the proximal surface 144.

When the sensor 104 is inserted into the internal cavity 128 and the spacer 108 is placed above or distally of the sensor 104, the proximal lip 154 surrounds the sensor 104, thereby restricting lateral movement of the sensor 104. The proximal ridge 156 does not compressibly engage the sensor 104 so as to restrict movement of the sensor 104 along the longitudinal axis 101. Rather, the proximal ridge 156 is disposed just distally of the sensor 104 to loosely restrict longitudinal movement of the circumferential portion 140 of the sensor 104. Those skilled in the art will recognize that the proximal ridge 156 may compressibly engage the sensor 104, thereby pressing the sensor 104 against the circumferential ridge 132 of the casing portion 102. Preferably, the proximal ridge 156 is disposed proximally enough away from the proximal surface 144 of the spacer 108 that when the sensor 104 operates from a concave position to a convex position, the central portion 142 of the sensor 104 does not come into contact with the proximal surface 144 of the spacer 108.

The shaft portion 106 is preferably a generally elongated solid cylindrical piece. The shaft portion 106 comprises a proximal shaft end portion 106*a* and a distal shaft end portion 106*b*. The shaft 106 is preferably adapted to pass through the central passageway 148. Those skilled in the art will recognize that although the shaft 106 and central passageway 148 are shown here having a generally cylindrical profile, any profile shape may be used.

Preferably, during assembly of the sensing system 100, the shaft 106 is inserted through the central passageway 148, engaging the central portion 142 of the sensor 104. The shaft 106 is preferably slidable through the central passageway 148 without much, if any frictional resistance.

The switch portion 110 comprises a generally cylindrical switch casing 158, having a proximal end 160 comprising a proximal lip 162. The proximal lip 162 extends circumferentially around the proximal end 160 of the switch casing 158. Preferably, the outer diameter of the proximal lip 162 is slightly smaller than the inner diameter of the exterior wall 126 of the barrel portion 120. Preferably, the inner diameter of the proximal lip 162 is larger than the outer diameter of the distal spacer surface 146, thereby allowing the proximal lip 162 to contact the distal surface of the circumferential reveal 152 while surrounding the distal spacer surface 146. A distal edge 164 of the proximal lip 162 defines the distal terminus of the proximal lip 162. The distal edge 164 of the proximal lip 162 is disposed proximally enough along the switch casing 158 that, when the switch portion 110 is inserted into the internal cavity 128 of the casing portion 102, the distal casing lip 166 exterior wall 126 extends distally of the distal edge 164 of the proximal lip 162.

Inside of the switch portion 110 is a circuit comprised of a first lead 168, operatively connected to a first terminal 170.

The first terminal 170 is disposed within the switch casing 158. The first terminal 170 is conductively and fixedly connected to a conductive member 172 that has a fixed portion and a flexible, movable portion. The conductive member 172 preferably comprises a fixed first contact end 174, a movable second contact end 176 and a "U" shaped spring section 178 disposed between the fixed first contact end 174 and the movable second contact end 176. The conductive member 172 is connected to the first terminal 170 at the first contact end 174.

A second lead 180 is operatively connected to a fixed second terminal 182. The movable second contact end 176 is biased towards the fixed second terminal 182 by the "U" shaped spring section 178. When the movable second contact end 176 contacts the fixed second terminal 182, there is a continuous electrical connection between the first lead 168 and the second lead 180. In such an instance, there is a closed circuit between the first lead 168 and the second lead 180. The movable second contact end 176 is operable away from the second terminal 182 by applying force to the movable second contact end 176 distally, thereby compressing the "U" shaped spring section 178.

Figure 10:
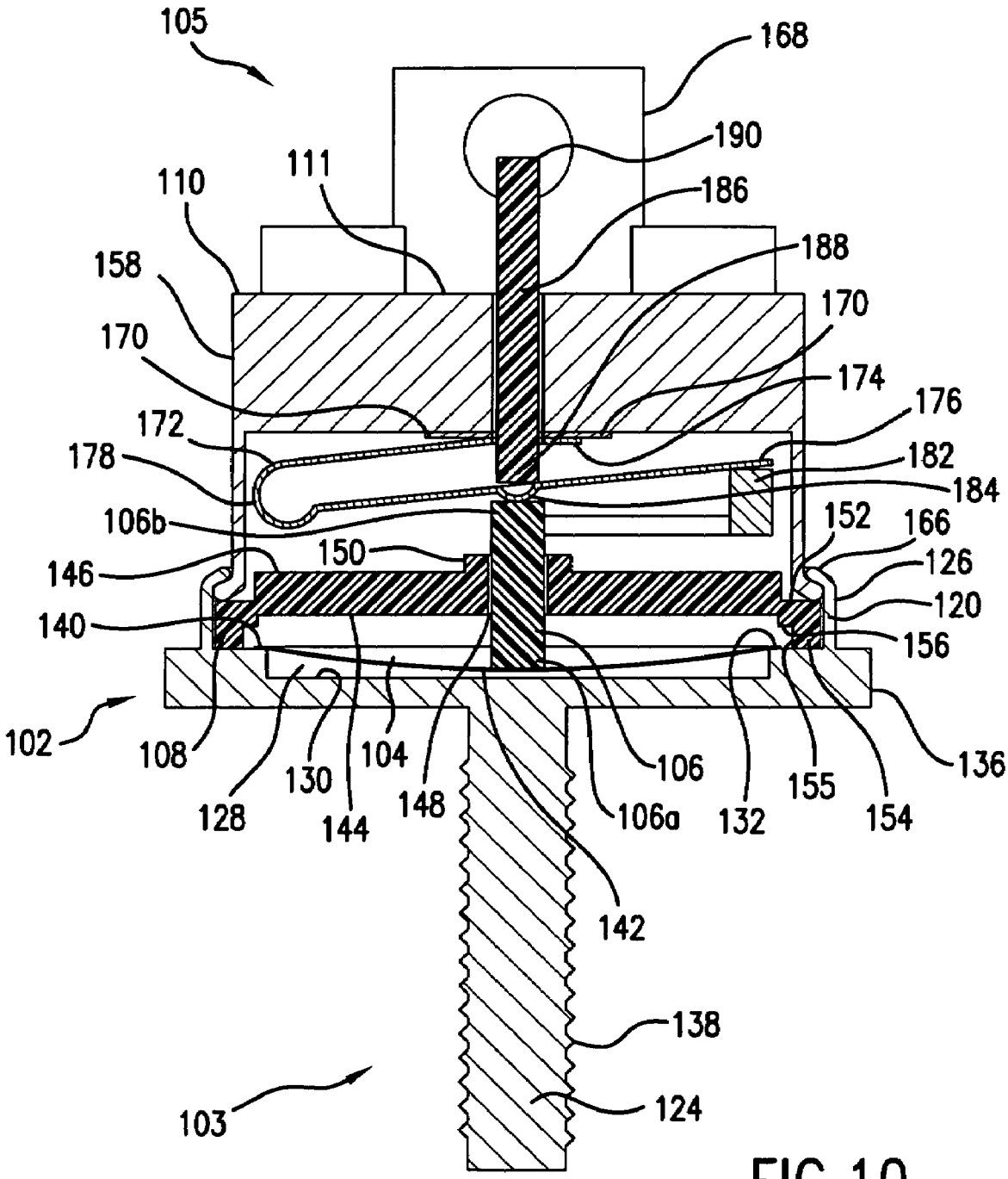
FIG. 10 is a cross sectional view of an embodiment of the sensing system of FIG. 6 in an assembled condition.
Figure 12:
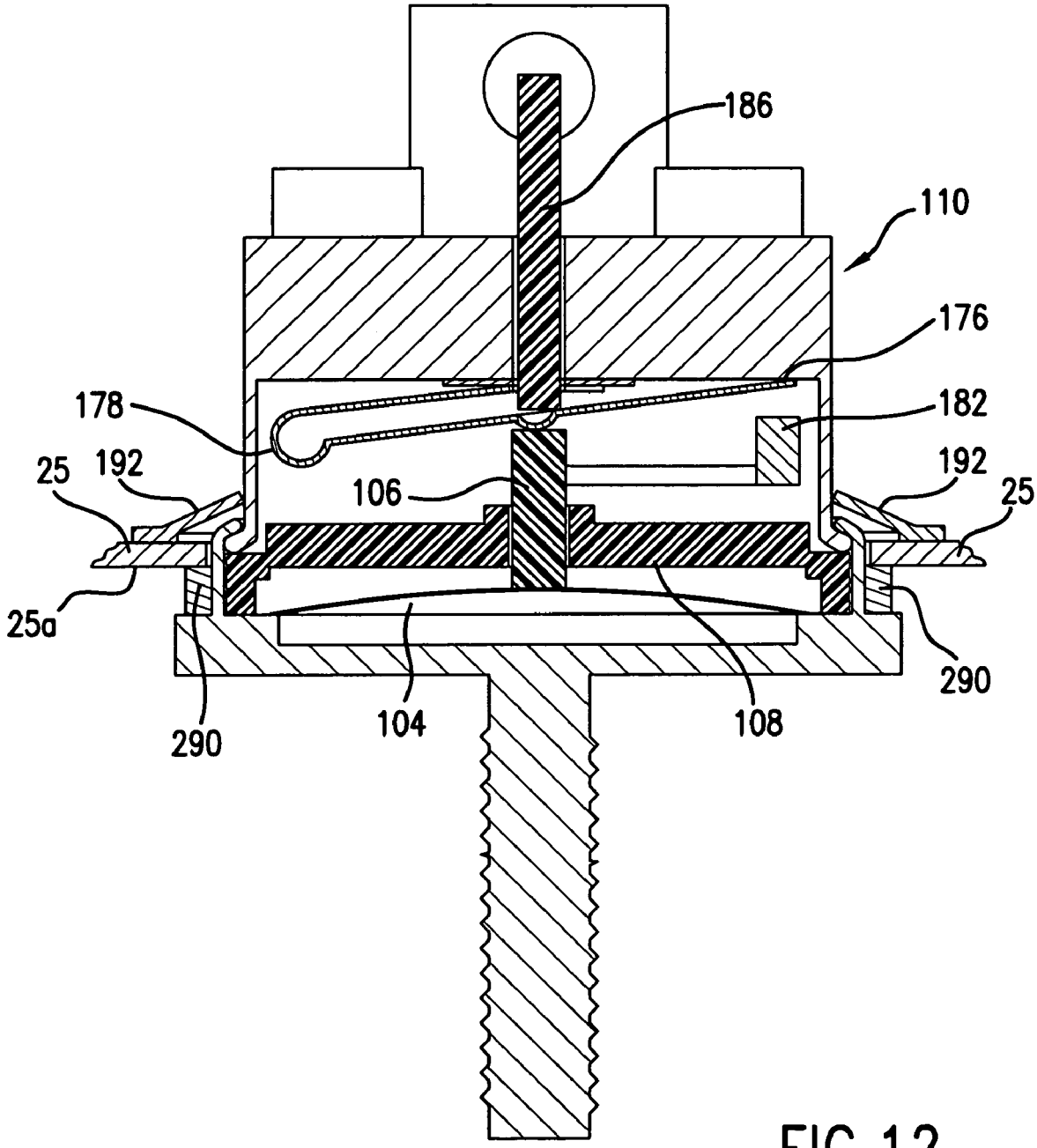
FIG. 12 is a cross sectional view of the sensing system of FIG. 8 in an open circuit condition.

As shown in FIG. 10, when the sensing system 100 is assembled, the distal shaft end 106*b* is disposed just below the second contact end 176. A raised convex contact surface 184 is disposed on the proximal surface of the movable second contact end 176. The raised convex contact surface 184 is adapted to contact the distal shaft end 106*b* in the event that the shaft 106 is translated in a distal direction, towards the conductive member 172. When the shaft 106 is translated in a distal direction, the distal shaft end 106*b* contacts the raised convex contact surface 184. In other words, convex contact surface 184 moves relative to the balance of switch portion 110 substantially in concert with the movability of shaft 106. If the shaft 106 is translated further distally, the second contact end 176 is translated distally and away from the fixed second terminal 182. Thus, movable contact end 176 also moves relative to the balance of switch portion 110 substantially in concert with shaft 106. When the movable second contact end 176 is translated away from the fixed second terminal 182, the conductive connection between the first lead 168 and the second lead 180 is broken, thereby rendering the switch portion 110 open, as best seen in FIG. 12.

It is preferable that the casing portion 102 be constructed from brass, or some other metal with similar heat conducting properties. The sensor 104 is made from materials known to those skilled in the art for bimetallic snap discs. The spacer 108 and the shaft 106 are preferably constructed from ceramic material. The switch portion 110 preferably comprises a combination of materials, each adapted to serve a specific purpose. By way of example, it is preferable that the leads 168, 180 the terminals 170, 182 and the flexible conductive member 172 conduct electricity. Preferably, the switch casing 158 and the reset shaft 186 are made from materials that generally insulate against conducting electricity and do not facilitate the flow of electricity therethrough, such as ceramic.

In assembly, as best seen in FIG. 10, where the bottom of the figure is the proximal direction and the top of the figure is the distal direction, the sensor 104 is first inserted into the interior cavity 128 of the casing portion 102. The sensor 104 is inserted 104 in a concave position, when viewed from the top or distal direction. This results in the central portion 142 of the sensor 104 being disposed closer to the interior wall 130 than the circumferential portion 140.

The spacer 108 is inserted into the interior cavity 128, above the spacer 104, so that the proximal lip 154 of the spacer engages the circumferential ridge 132 of the casing portion 102. When the proximal lip 154 of the spacer engages the circumferential ridge 132 of the casing portion 102, the sensor 104 is disposed between the casing portion 102 and the spacer 108. There should be sufficient space between the casing portion 102 and the spacer 108 to allow the sensor 104 to operate between concave and convex dispositions.

The shaft 106 is inserted through the central passageway 148 so that the proximal shaft end 106*a* engages the distal side of the central portion 142 of the sensor 104. When the proximal shaft end 106a engages the distal side of the central portion 142 of the sensor 104, the proximal shaft end 106b extends proximally from the distal lip 150 of the spacer 108.

The proximal lip 162 of switch portion 110 is then inserted into the internal cavity 128 of the barrel portion 120. The switch portion 110 is inserted far enough into the internal cavity 128 that the distal edge 164 of the proximal lip 162 is proximal of the distal casing lip 166. During assembly, the distal casing lip 166 is rolled towards the longitudinal axis 101, thereby retaining the switch portion 110 partially within the casing portion 102. The switch portion 110 is further partially retained within the casing portion 102 by sizing the pieces so that a press fit exists between the outer circumferential surface of the proximal lip 162 and the inner surface of the exterior wall 126 of the barrel portion 120.

A movable reset shaft 186 extends through the switch portion 110 along the longitudinal axis 101. A proximal end 188 of the reset shaft 186 is adapted to engage a distal surface 177 of the movable second circuit end 176. Thus, the reset shaft moves relative to the balance of switch portion 110 substantially in concert with shaft 106, convex contact surface 184 and movable contact end 176. A distal end 190 if the reset shaft 186 extends distally beyond a distal surface 111 of the circuit portion 110.

When the sensing system 100 is assembled, and the sensor 104 is in a concave position when viewed from the distal direction, it is preferable that the movable second contact end 176 is in contact with the fixed second terminal 182. It is preferable that the shaft 106 is disposed between the distal surface of the central portion 142 of the sensor 104 and the raised convex contact surface 184, without engaging the raised convex contact surface 184 at all, or alternatively, without applying enough force the raised convex contact surface 184 to move the movable second circuit end 176 away from the fixed second terminal 182.

Figure 3A:
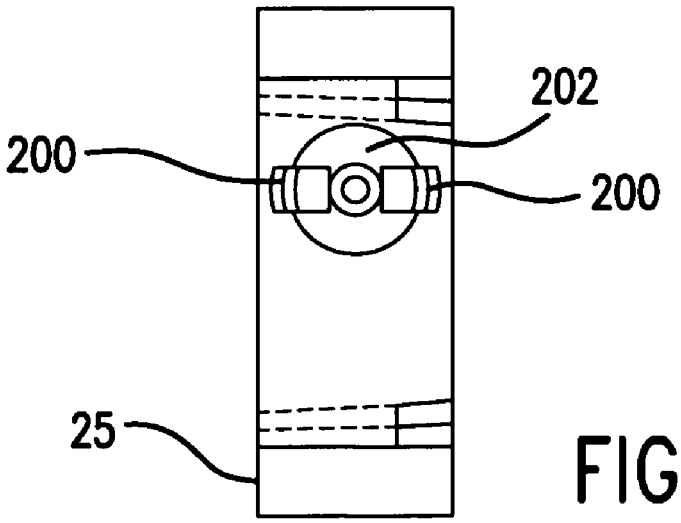
FIG. 3A is an exploded view of a portion of the structure shown in FIG. 3.
Figure 4:
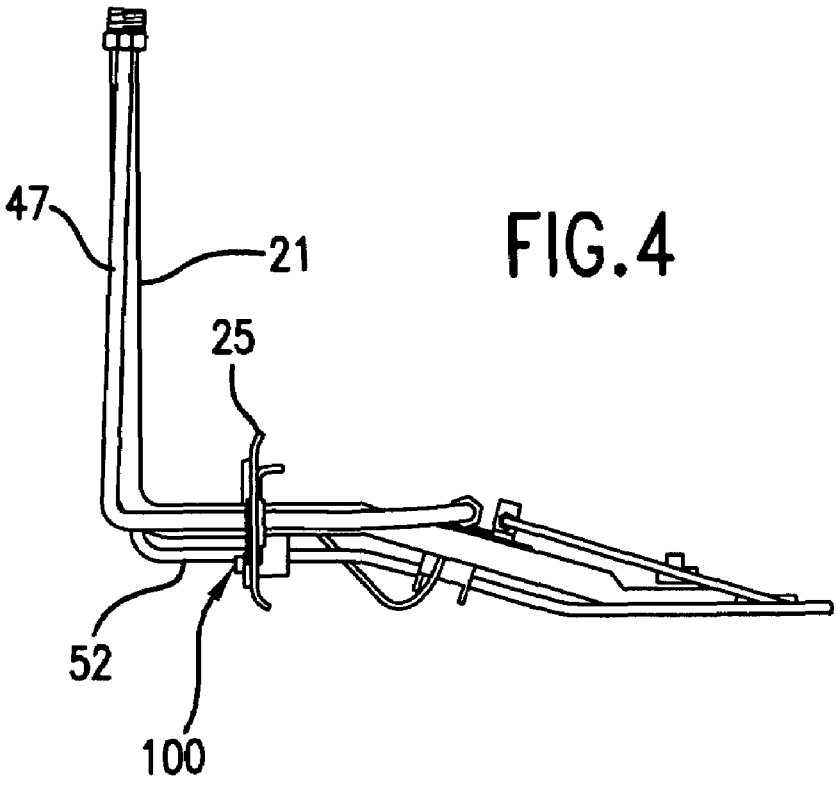
FIG. 4 is a side view of a fuel supply line assembly with the burner removed for ease of understanding.

Preferably, the assembled system 100 is installed into the access plate 25 by inserting the system 100, distal end 105 first, through an aperture in the plate 25. The system 100 is preferably inserted from an interior side of the plate 25, when the plate 25 is installed on the water heater 2. The installation of the system 100 into the plate may be done before the plate 25 is installed onto the water heater 2. Referring to FIG. 3A, a die contacts plate 25 to punch a hole for system 100 and forms tabs 200 that extend outwardly from plate 25. The system 100 is then placed into plate 25 through the newly formed hole from the interior. A press then contacts tabs 200 and forms them over the round cap portion 202 of switch portion 110.

Figure 11:
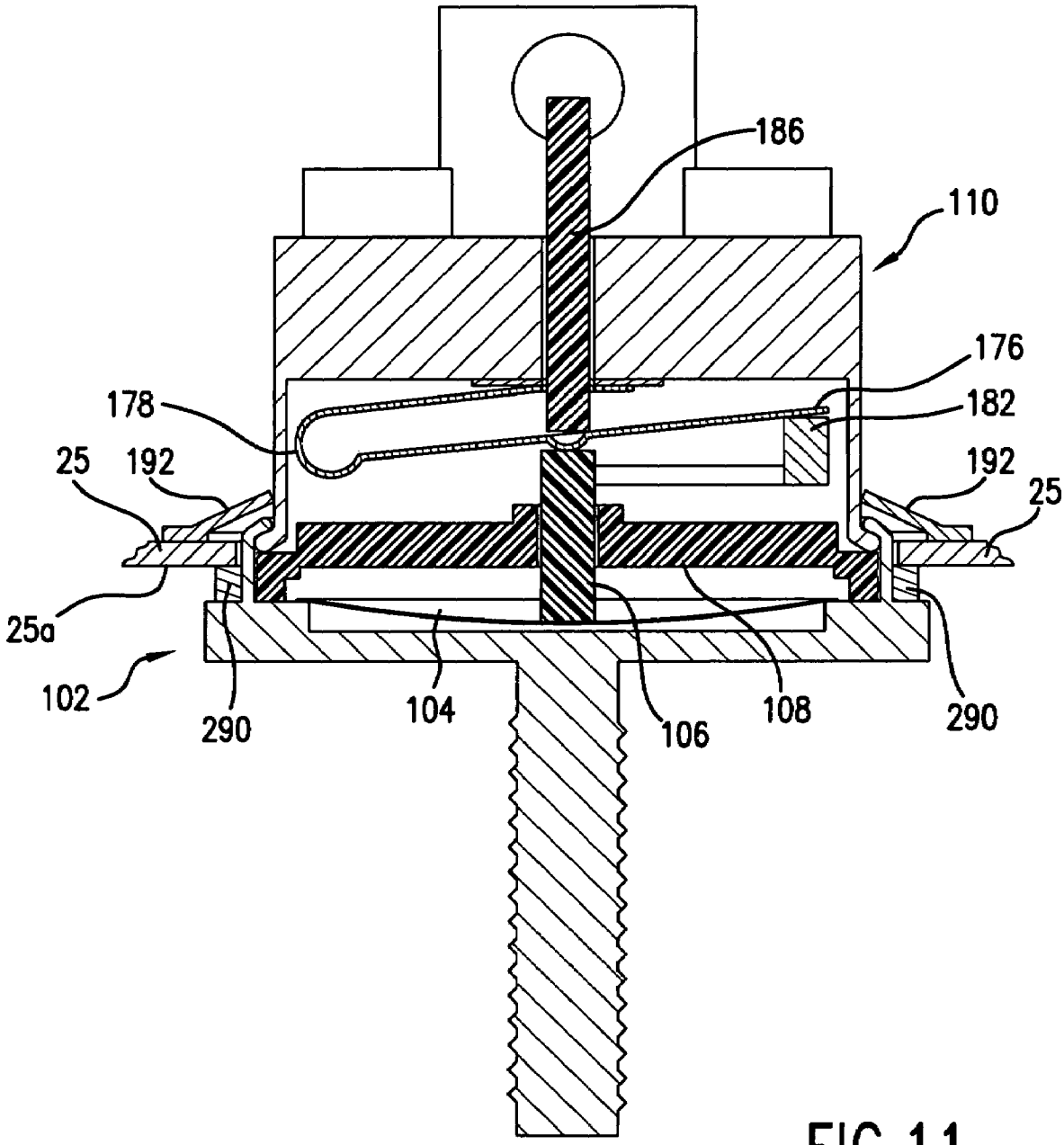
FIG. 11 is a cross sectional view of the sensing system of FIG. 7 in a closed circuit condition, inserted in an access plate.

Referring now to FIGS. 11 and 12, the system 100 is inserted through the plate 25 only far enough that the switch portion 110 extends through the plate 25. Preferably all, or at least a portion, of the barrel portion 120 is disposed either within the aperture of the plate 25 or on the interior (proximal) side of the plate 25. There is a space between the distal side of the flange portion 122 and a proximal face 25*a* of the plate 25. A spacer 190 may be disposed between the flange portion 122 and the plate 25 to restrict the distal movement of the sensing assembly 100. The switch portion 110 is preferably disposed entirely outside of the plate 25, although those skilled in the art will recognize that all or a portion of the switch portion 110 may be disposed within plate 25 or the combustion chamber 15.

The sensing assembly 100 may be retained in place, in relation to the plate 25 by a slip ring fastener 192, or push nut fastener, as is known to those skilled in the art. The fastener 192 preferably compressibly engages the circuit casing 158, applying inward and distal force on the sensing assembly 100. Preferably, the fastener 192 biases the sensing system distally, so that the flange 122 compressibly engages the spacer 190 against the proximal face 25*a* of the plate 25. Various alternative methods of mounting the system 100 to the plate 25 are possible. By way of example, a portion of the casing 158 or the exterior wall 126 of the barrel portion 120 may be threaded. Correspondingly, mating threads (not shown) may be disposed on the plate 25. Additionally, the assembly 100 and a corresponding recess (not shown) in the plate 25 may be shaped to create a mechanical engagement, such as a quarter-turn lock, between the assembly and the plate. The assembly 100 may also be retained in relation to the plate 25 through the use of "C" or "E" clips, or through spot welding a portion of the assembly to the plate 25. Alternatively, there may be at least one, and preferably two, holes in the switch portion 110 and corresponding hole(s) in the plate 25. The assembly 100 may be retained to the plate 25 using a stud or other well known fasteners.

Because the barrel portion 120 is disposed within the plate 25 or proximally of the plate 25, the sensor 104 is mounted interiorly of the plate 25. The sensor 104 is disposed at a point along the longitudinal axis 101 that is generally even with the distal edge of the flange 122. This disposition ensures that the sensor 104 is disposed interiorly of the plate 25. The distance between the proximal face 25*a* of the plate 25 and the sensor 104 is large enough that even when the sensor 104 is operated from a concave to a convex disposition, the entirety of the sensor 104 is disposed interiorly of the plate 25.

In operation, the switch portion 110 is connected in series to a power source on one end and the valve 48 on the other end. Generally, since the switch portion 110 is normally disposed in the closed position, the switch portion 110 facilitates the flow of electrical current from the power source to the gas control valve 48. The valve 48 is adapted to close when power is interrupted via the opening of the circuit. When the valve 48 closes, the flow of fuel to the burner 14 is stopped.

Generally, combustion occurs in the combustion chamber 15 at a predetermined temperature. This temperature is set according to ways known to those skilled in the art. Those skilled in the art will also recognize that certain events may cause the temperature in the combustion chamber 15 to rise above the predetermined level. Such a rise in combustion chamber 15 temperature may be indicative of a change in the operating characteristics in the combustion chamber 15 such as a flammable vapor event, or the accumulation of the combustion air intake area with lint, dust, oil or other debris, thereby causing the burner 14 to burn in an inefficient fuel-rich condition. When the inefficient, fuel-rich combustion occurs, undesirable levels of carbon monoxide may be released. There may also be other undesirable conditions indicated by an elevated temperature in the combustion chamber 15 as is known to those skilled in the art.

The casing portion 102 is the part of the sensor system 100 that is disposed closest to the burner 14. Therefore, the casing portion is directly exposed to the heat of the combustion chamber 15. Heat is conducted through the casing portion 102 to the interior cavity 128. The sensor 104 senses the temperature of the interior cavity 128. By sensing the temperature of the interior cavity 128, the sensor 104 senses the temperature of the combustion chamber 15.

When the sensor 104 reaches a predetermined temperature, the sensor 104 operates from a concave position, as shown in FIG. 11, to a convex position, as shown in FIG. 12. When the sensor 104 operates from concave to convex, the distal movement of the central portion 142 of the sensor 104 translates the shaft 106 distally such that the shaft 106 does not extend or project into combustion chamber 15 at all, thereby translating the movable second circuit end 176 distally and away from the fixed second terminal 182. Generally, for natural gas models, the predetermined temperature at which the sensor 104 operates from a concave to a convex disposition is in the range between 400 and 460 degrees Fahrenheit. A preferred embodiment of a sensor 104 is adapted to operate from a concave to a convex disposition at 450 degrees Fahrenheit. For models using propane as a fuel, it is preferable to have the predetermined temperature between 300 and 350 degrees Fahrenheit. Those skilled in the art will recognize that the predetermined temperature at which the sensor 104 operates from a concave to a convex disposition may vary outside of the above-mentioned range.

When the movable second circuit end 176 is moved away from the fixed second terminal 182, the circuit is opened and current no longer flows through the switch portion 110 from the first lead 168 to the second lead 180. This interruption in the flow of current through the switch portion 110 to the valve 48 triggers the valve 48 to close and restrict the flow of fuel to the burner 14. The closing of the valve 48 when power is terminated thereto is a procedure that is well known to those skilled in the art.

Preferably, when the circuit is opened, and power to the gas control valve 48 is terminated, gas is no longer permitted to flow to the burner. When gas ceases to flow to the burner 14, combustion in the combustion chamber 15 is stopped.

The sensing system may be reset by pushing the reset shaft 186 proximally. When pushed proximally, the reset shaft 186 engages the movable second circuit end 176, which engages the shaft 106, which engages the sensor 104. When a user applies proximal force to the reset shaft 186, the above-described chain of engagement ultimately applies force to the central portion 142 of the sensor 104 and "flip" the sensor 104 from a convex disposition back to a concave disposition.

A variety of modifications to the aspects described will be apparent to those skilled in the art from the disclosure provided herein. Thus, aspects of the invention may be embodied in other specific forms without departing from the spirit or attributes thereof and, accordingly, reference should be made to the appended claims, rather than to the foregoing specification, as indicating the scope of our disclosure.

What is claimed is:

1. A water heater comprising:

a water container;

a combustion chamber disposed below the water container and formed at least partially by a shell having an interior surface;

a burner disposed within the combustion chamber;

a fuel supply line connected to the burner;

a valve associated with the fuel supply line;

a movable combustion chamber sensor disposed interiorly of the shell proximate to the interior surface comprising a combustion chamber sensor that is a generally circular disc, normally biased in a concave position and adapted to operate to a convex position upon reaching a predetermined temperature, and adapted to sense a rise in temperature indicative of a selected amount of carbon monoxide present in the combustion chamber; and a switch associated with the sensor and operatively associated with the valve such that the switch triggers the valve to shut off fuel to the burner in response to a sensed temperature by the sensor.

2. The water heater according to claim 1, wherein the switch further comprises a movable reset switch.

3. The water heater according to claim 1, wherein the combustion chamber sensor further comprises a casing having a hollow portion and a sensing protrusion extending away from the hollow portion.

4. The water heater according to claim 3, wherein the combustion chamber sensor is disposed within the hollow portion and adapted to sense the temperature of the combustion chamber sensor casing.

5. The water heater according to claim 1, further comprising a shaft portion disposed between the sensor and the switch and adapted to move toward the switch when the sensor shifts from the concave position to the convex position such that the shaft does not project or extend into the combustion chamber.

6. The water heater according to claim 1, wherein the switch is normally closed and operation of the combustion chamber sensor from the concave position to the convex portion causes the normally closed switch to open, thereby closing the valve.

7. The water heater according to claim 1, wherein the sensor is resetable.

8. The water heater according to claim 1, wherein the abnormality is a rise in carbon monoxide content in the combustion chamber.

9. The water heater according to claim 1, wherein the abnormality is a rise in combustion temperature in the combustion chamber.

10. The water heater according to claim 1, wherein the abnormality comprises combustion of extraneous fumes.

11. The water heater according to claim 1, wherein switch is in series with the valve.

12. The water heater according to claim 1, wherein the shell further comprises an access door covering an opening in the shell.

13. The water heater according to claim 12, wherein the combustion chamber sensor is attached to and disposed interiorly of the access door.

14. A water heater comprising:

a water container;

a combustion chamber disposed below the water container and formed at least partially by a shell having an interior surface;

a burner disposed within the combustion chamber;

a fuel supply line connected to the burner;

a valve associated with the fuel supply line;

a movable combustion chamber sensor comprising a generally circular disc, normally biased in a concave position and adapted to operate to a convex position upon reaching a predetermined temperature, disposed interiorly of the shell proximate to the interior surface of the shell, and adapted to sense a rise in temperature indicative of an abnormality in the combustion chamber; and a switch associated with the sensor and operatively associated with the valve such that the switch triggers the valve to shut off fuel to the burner in response to a sensed temperature by the sensor.

15. The water heater according to claim 14, further comprising a shall portion disposed between the sensor and the switch and adapted to move toward the switch when the sensor shifts from the concave position to the convex position such that the shaft does not project or extend into the combustion chamber.

16. The water heater according to claim 15, wherein the switch is normally closed and operation of the combustion chamber sensor from the concave position to the convex portion causes the normally closed circuit to open, thereby closing the valve.

* * * * *